United States Patent [19]

Samera, Jr. et al.

[11] Patent Number: 4,951,580

[45] Date of Patent: Aug. 28, 1990

[54] WASTE FEED ARRANGEMENT

[75] Inventors: Edward Samera, Jr., Anaheim; Ceasar U. Kosi, Garden Grove, both of Calif.

[73] Assignee: Westinghouse Electric Corp., Pittsburgh, Pa.

[21] Appl. No.: 473,522

[22] Filed: Feb. 1, 1990

[51] Int. Cl.[5] ..... A47J 36/00; A47J 36/24

[52] U.S. Cl. ..... 110/246; 110/109; 110/226; 110/289

[58] Field of Search ..... 110/246, 226, 109, 289, 110/290, 291; 414/198

[56] References Cited

U.S. PATENT DOCUMENTS

| | | | |
|---|---|---|---|
| 3,098,458 | 7/1963 | Lantz, Jr. | 110/246 X |
| 4,714,031 | 12/1987 | Healy et al. | 110/109 |
| 4,726,765 | 2/1988 | O'Connor | 110/246 X |
| 4,735,156 | 4/1988 | Johnson et al. | 110/246 |

*Primary Examiner*—Edward G. Favors
*Attorney, Agent, or Firm*—Fred J. Baehr, Jr.

[57] ABSTRACT

An improved waste feed arrangement for feeding waste into a rotary combustor including a stepped support frame and a ram which pushes the waste through a doorway into the rotary combustor, the ram slidably engaging an upper step of the support frame and has a bracket on the outboard end to which a cam follower is rotatably attached, the cam follower rolls on a lower step of the support frame and a hydraulic cylinder is connected between the bracket on the ram and a bracket disposed in the support frame in such a manner that the hydraulic cylinders piston rod pushes the ram away from the doorway as it extends from the hydraulic cylinder providing a smaller, totally covered hydraulic cylinder and piston rod and an improved waste feed system.

3 Claims, 2 Drawing Sheets

WASTE FEED ARRANGEMENT

BACKGROUND OF THE INVENTION

The invention relates to a municipal waste incinerator and more particularly to an improved hydraulic cylinder and feed ram arrangement for feeding a rotary combustor.

U.S. Pat. No. 4,714,031 describes an arrangement for feeding material to the open end of a rotary combustor for a municipal waste incinerator having a vertical chute leading to a doorway to the combustor which is normally closed by a biased door and a stepped ram reciprocating at the bottom of the chute for feeding material through the door and into the combustor. The ram is disposed on the same incline as the combustor, about 6 degrees. The piston rod of a hydraulic cylinder is extended to push the waste into the rotary combustor.

SUMMARY OF THE INVENTION

Among the objects of the invention may be noted the provision of smaller hydraulic cylinder and totally covering it with the ram in such a manner so as to push the ram away from the door when the piston is extended.

In general, an improved waste feed arrangement having a hydraulic cylinder and a feed ram that feeds waste into a municipal waste incinerator which includes a rotary combustor that is disposed on an incline with a chute for receiving waste and an opening in a lower end of the chute through which the waste is fed into an upper end of the inclined rotary combustor, when made in accordance with this invention, comprises a support frame disposed at the bottom of the chute and on the same incline as the rotary combustor and having an upper and a lower portion; a wear plate disposed on the bottom of the ram in sliding engagement with the upper portion of the support frame; the hydraulic cylinder being disposed within the support frame and having its base attached thereto. A bracket is attached to the ram on the end opposite the end that is adjacent the rotary combustor. The bracket has the piston rod attached thereto and a roller is rotatably attached to the bracket and disposed to roll on the lower portion of the support frame. The hydraulic cylinder, piston and piston rod are so disposed under the ram that the hydraulic cylinder applies it maximum force as it pushes the ram away from the rotary combustor and up the incline.

BRIEF DESCRIPTION OF THE DRAWINGS

The invention as set forth in the claims will become more apparent by reading the following detailed description in conjunction with the accompanying drawings, wherein like reference numerals refer to like parts through the drawings and in which:

DESCRIPTION OF THE PREFERRED EMBODIMENT

Figure 1:
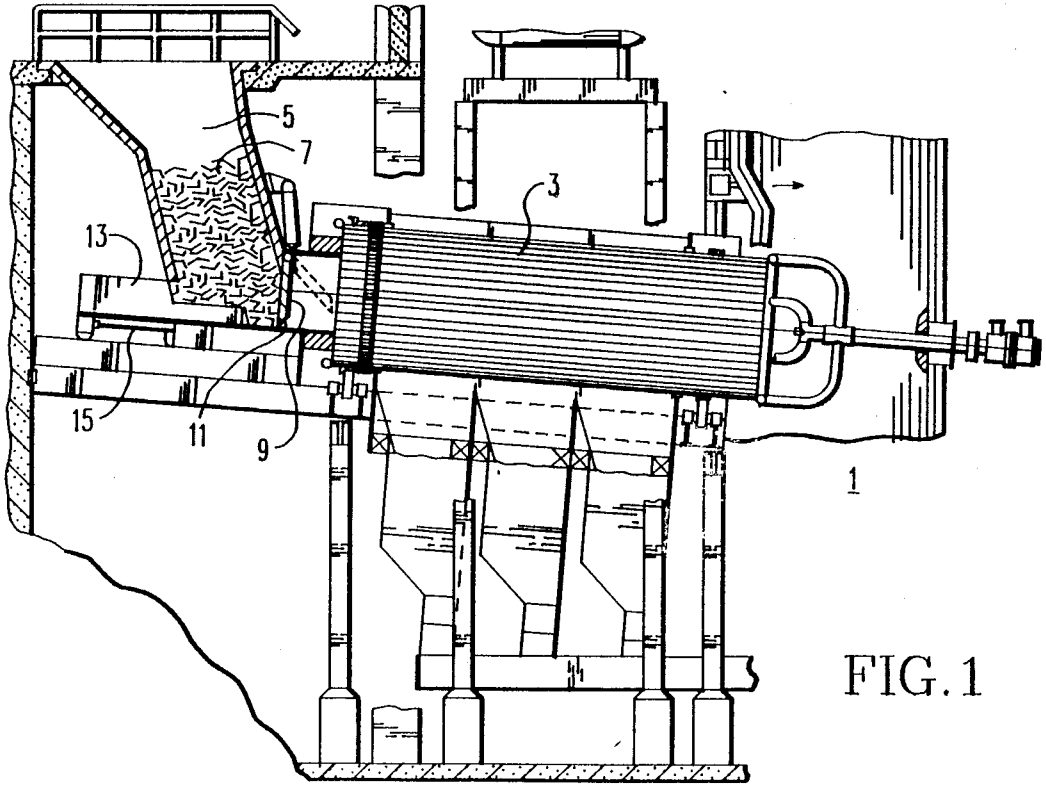
FIG. 1 is partial sectional view of a municipal waste incinerator with an improved waste feed arrangement.

Referring now to the drawings in detail and in particular to FIG. 1 there is shown a municipal waste incinerator 1 having a rotary combustor 3 which is disposed on an incline of about 6 degrees and a chute 5 for receiving municipal waste 7. The waste chute 5 has an opening 9 with a door 11 biased in the closed direction in its lower end. A ram 13 disposed adjacent the opening 9 on the same incline as the rotary combustor 3 is reciprocated by a hydraulic cylinder 15 to push the municipal waste 7 through the opening 9, causing the door 11 to open and dump the waste 7 into the upper end of the rotary combustor 3.

Figure 2:
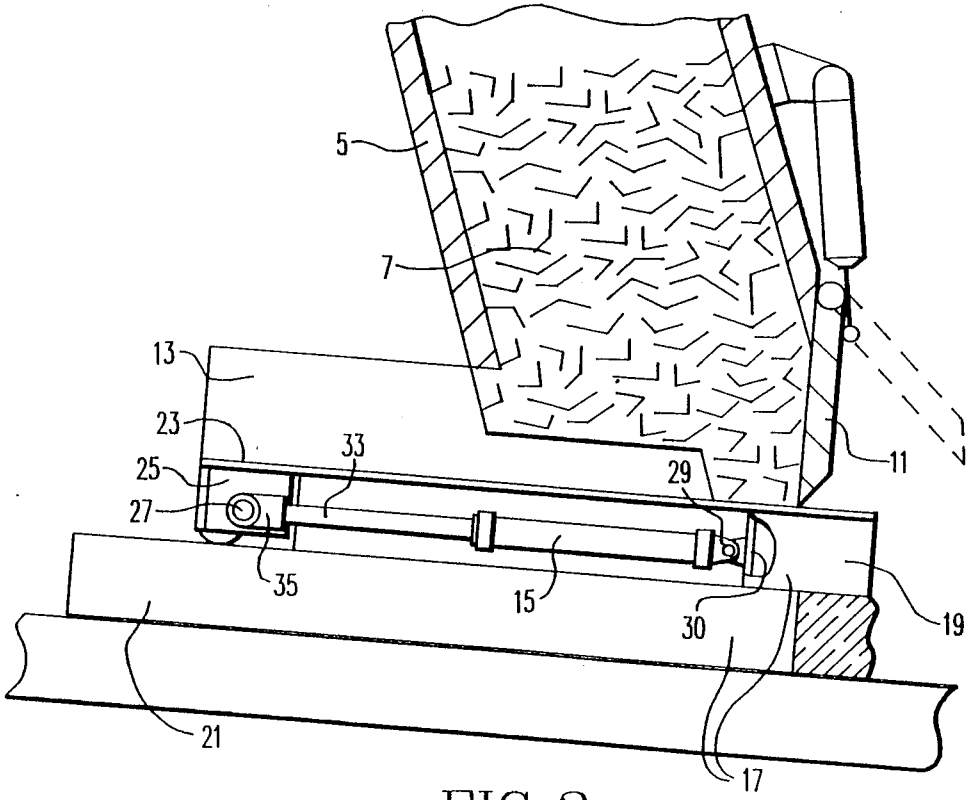
FIG. 2 is a enlarged sectional view of the improved waste feed arrangement.

The improved waste feed arrangement, as shown best in FIG. 2, comprises a support frame 17 disposed at the bottom of the chute 5 and on the same incline as the rotary combustor 3. The support frame 17 has an upper portion 19 and a lower portion 21. A wear plate 23 is disposed on the bottom of the ram 13 in sliding engagement with the upper portion 19 of the support frame 17. The ram 13 also has a bracket 25 on the end opposite the end that is adjacent the rotary combustor 3. A cam follower or roller 27 is rotatably mounted on the bracket so as to roll on the lower portion 21 of the support frame 17 as the ram 13 reciprocates. The hydraulic cylinder 15 has a base portion that includes a clevis arrangement 29. The clevis arrangement 29 is fastened to a bracket 30 welded in the upper portion 19 of the support frame 17. The hydraulic cylinder also has a piston (not shown) and piston rod 33 which has a clevis arrangement 35 that is fastened to the bracket 25 on the end of the ram 13. Thus, the hydraulic cylinder 15 is so disposed with respect to the support frame 17 and the ram 13 that the hydraulic cylinder 15 and piston rod 33 are completely covered by the ram and applies their maximum force to move the ram 13 away from the opening 9 and up the incline, allowing the utilization of a smaller hydraulic cylinder 15 and providing complete coverage of the piston rod 33 during all portions of its operation. Covering the hydraulic cylinder 15 and piston rod 33 protects it from small debris which collects on top of the ram 13 and would fall on an uncovered piston rod and destroy the seal between the piston rod 33 and the hydraulic cylinder 15.

While the preferred embodiments described herein set forth the best mode to practice this invention presently contemplated by the inventor, numerous modifications and adaptations of this invention will be apparent to others skilled in the art. Therefore, the embodiments are to be considered as illustrative and exemplary and it is understood that the claims are intended to cover such modifications and adaptations as they are considered to be within the spirit and scope of this invention.

What is claimed is:

1. An Improved waste feed arrangement having a hydraulic cylinder and a feed ram that feeds waste into a municipal waste incinerator which includes a rotary combustor that is disposed on an incline with a chute for receiving waste and an opening in a lower end of the chute through which the waste is fed into an upper end of the inclined rotary combustor, said improved waste feed arrangement comprising a support frame disposed at the bottom of the chute and on the same incline as the rotary combustor and having an upper and a lower portion; a wear plate disposed on the bottom of the ram in sliding engagement with the upper portion of the support frame; the hydraulic cylinder being disposed within the support frame and having its base attached thereto; the hydraulic cylinder having a piston and piston rod, a bracket attached to the ram on an end opposite the end that is adjacent the rotary combustor, the bracket having the piston rod attached thereto; and a roller rotatably attached to the bracket and disposed to roll on the lower portion of the support frame; the hydraulic cylinder, piston and piston rod being so disposed under the ram that the hydraulic cylinder applies it maximum force as it pushes the ram away from the rotary combustor and up the incline.

2. The improved waste feed arrangement of claim 1, wherein the hydraulic cylinder is pivotally attached to the support frame and to the bracket.

3. The improved waste feed arrangement of claim 1, wherein the hydraulic cylinder is attached to the support frame and to the bracket by a clevis mounting arrangement.

* * * * *